United States Patent [19]

Arkans et al.

[11] 4,253,449

[45] Mar. 3, 1981

[54] COMPRESSION DEVICE WITH CONNECTION SYSTEM

[75] Inventors: Edward J. Arkans, Schaumburg; Larry D. Annis, Elgin; Norbert W. Ellmann, Lake Zurich, all of Ill.

[73] Assignee: The Kendall Company, Boston, Mass.

[21] Appl. No.: 65,392

[22] Filed: Aug. 9, 1979

[51] Int. Cl.[3] ..... A61H 1/00

[52] U.S. Cl. ..... 128/24 R; 128/64

[58] Field of Search ..... 128/24 R, 64, 30.2, 128/299

[56] References Cited

U.S. PATENT DOCUMENTS

| | | | |
|---|---|---|---|
| 2,145,932 | 2/1939 | Israel | 128/24 R |
| 2,674,231 | 4/1954 | Erickson | 128/24 R |
| 2,781,041 | 2/1957 | Weinberg | 128/299 |
| 3,177,866 | 4/1965 | Wesslund | 128/24 R |
| 3,288,132 | 11/1966 | Meredith | 128/24 R |
| 4,013,069 | 3/1977 | Hasty | 128/24 R |
| 4,029,087 | 6/1977 | Dye et al. | 128/24 R |
| 4,030,488 | 6/1977 | Hasty | 128/24 R |
| 4,091,804 | 5/1978 | Hasty | 128/24 R |
| 4,156,425 | 5/1979 | Arkans | 128/24 R |

FOREIGN PATENT DOCUMENTS

| | | | |
|---|---|---|---|
| 276620 | 11/1969 | Austria | 128/64 |
| 481481 | 10/1951 | Italy | 128/24 R |

*Primary Examiner*—John D. Yasko

*Attorney, Agent, or Firm*—Powell L. Sprunger

[57] ABSTRACT

A device for applying compressive pressures against a patient's limb from a source of pressurized fluid. The device has a pair of elongated pressure sleeves for enclosing a length of the patient's limbs, with the sleeves having a plurality of fluid pressure chambers. The device has a conduit system for connection and disconnection of the source to and from the sleeves.

31 Claims, 21 Drawing Figures

FIG. 1
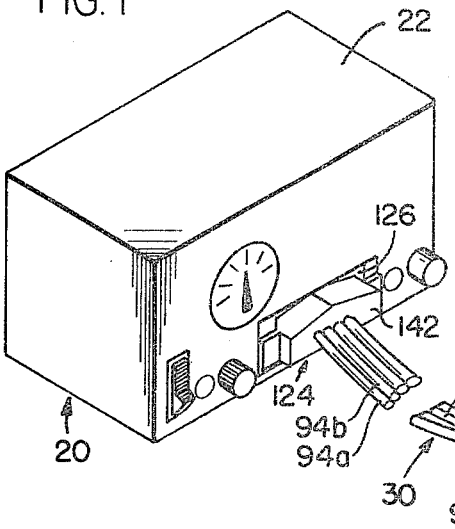
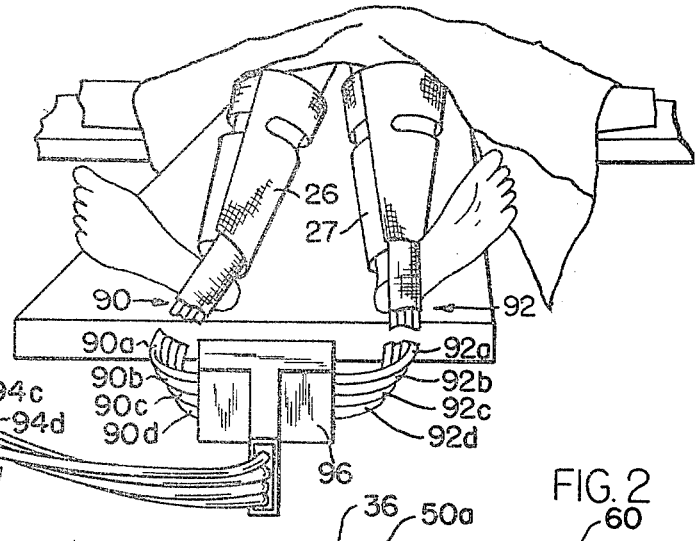
FIG. 2
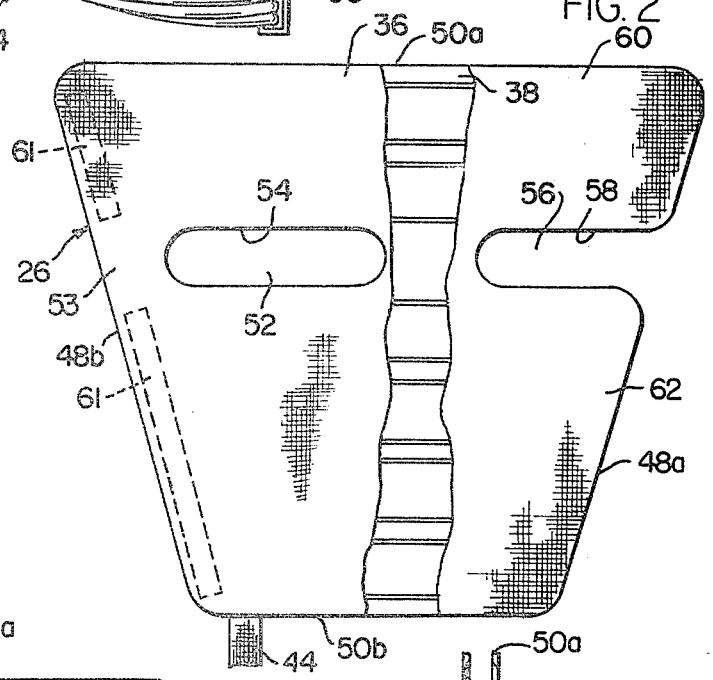
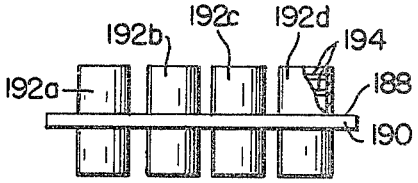
FIG. 18
FIG. 3
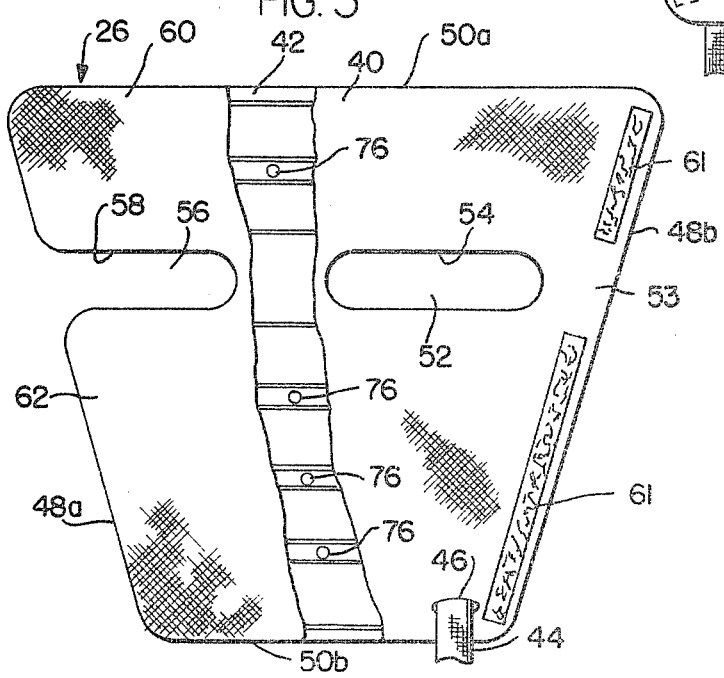
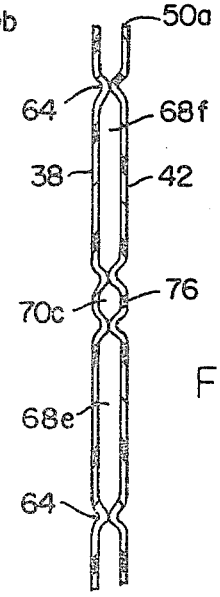
FIG. 8

FIG. 6
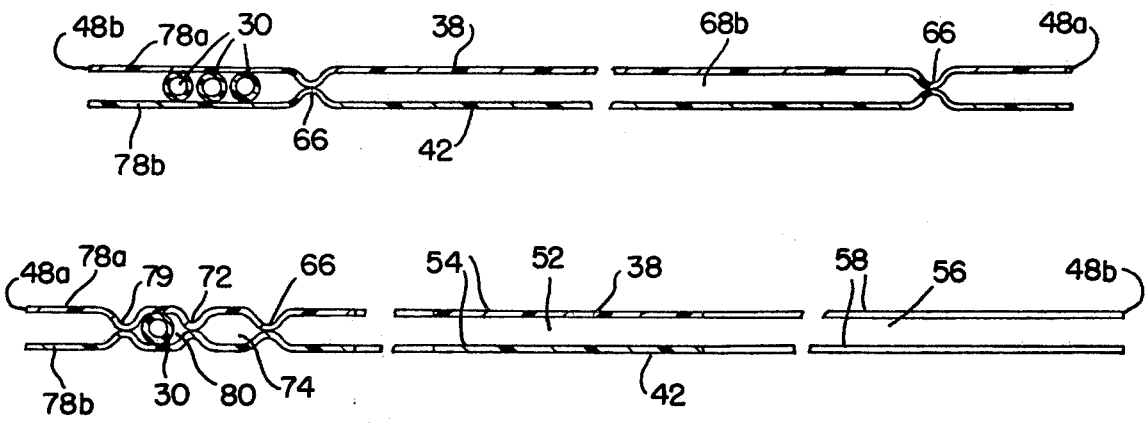
FIG. 7
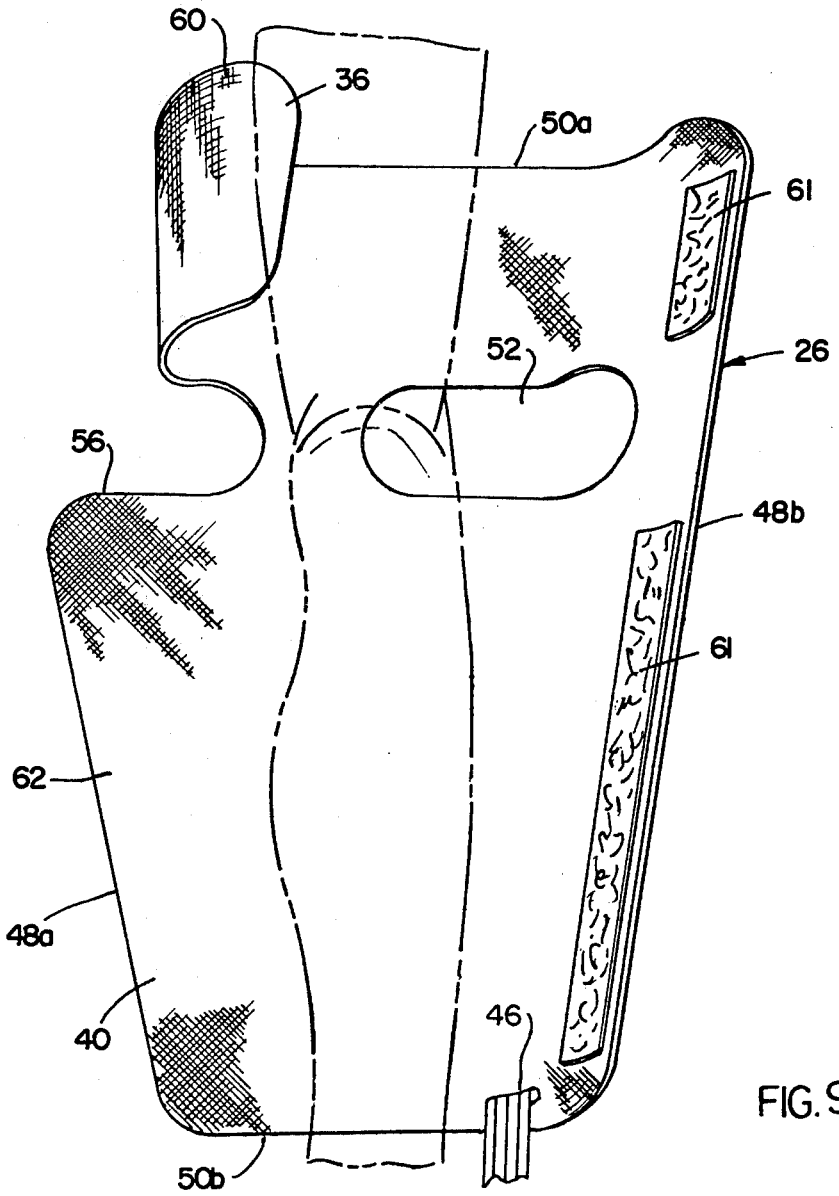
FIG. 9

COMPRESSION DEVICE WITH CONNECTION SYSTEM

BACKGROUND OF THE INVENTION

The present invention relates to therapeutic and prophylactic devices, and more particularly to devices for applying compressive pressures against a patient's limb.

It is known that the velocity of blood flow in a patient's extremities, particularly the legs, markedly decreases during confinement of the patient. Such pooling or stasis of blood is particularly pronounced during surgery, immediately after surgery, and when the patient has been confined to bed for extended periods of time. It is also known that stasis of blood is a significant cause leading to the formation of thrombi in the patient's extremities, which may have a severe deleterious effect on the patient, including death. Additionally, in certain patients it is desirable to move fluid out of interstitial spaces in extremity tissues, in order to reduce swelling associated with edema in the extremities.

Devices have been disclosed in U.S. Pat. Nos. 4,013,069 and 4,030,488, incorporated herein by reference, which develop and apply the desired compressive pressures against the patient's limbs. Such devices comprise a pair of sleeves which envelope the patient's limbs, and a controller for supplying fluid pressure to the sleeves. It is desirable that the sleeves may be readily connected to the controller, and rapidly disconnected from the system in the event of an emergency.

SUMMARY OF THE INVENTION

A principal feature of the present invention is the provision of an improved device for applying compressive pressures against a patient's limb.

The device comprises a pair of first and second elongated pressure sleeves for enclosing a length of the patient's limbs, with the sleeves each having a plurality of fluid pressure chambers, and a controller for supplying fluid pressures to the sleeves. The device has a first set of a plurality of conduits in communication with chambers in the first sleeve, a second set of a plurality of conduits in communication with chambers in the second sleeve, and a third set of a plurality of conduits in communication with the pressure supply of the controller. The device has a connection member which separately connects the conduits of the third set with the conduits of the first and second sets. The device also has attachment members for connecting the third conduit set to the controller. The device also has connection members for releasably connecting conduit sections in the first and second conduit sets together in sealing communication.

A feature of the present invention is that the conduit system distributes the pressurized fluid from the controller and third conduit set to the separate sleeves associated with the first and second conduit sets.

Another feature of the invention is that the third conduit set may be readily attached to and disconnected from the controller when desired, such that the controller may be supplied to the user separate from the conduit system and the sleeves.

Another feature of the invention is that the connection members in the first and second conduit sets permit simplified attachment and disconnection of either sleeve from the associated conduit set.

Thus, another feature of the invention is that the conduit system may be supplied separately to the user from the sleeves, and different sleeves may be utilized with a given conduit set and controller, as desired.

Still another feature of the invention is that the conduit system permits quick disconnection of a sleeve from the conduit system in the event of an emergency.

A further feature of the invention is that the controller, sleeves, and conduit system may be assembled together in a simplified manner preparatory to use of the device.

Further features will become more fully apparent in the following description of the embodiments of this invention and from the appended claims.

DESCRIPTION OF THE DRAWINGS

In the drawings:

FIG. 1 is a fragmentary perspective view of a compression device of the present invention;

FIG. 2 is a front plan view, partly broken away, of a compression sleeve for the device of FIG. 1;

FIG. 3 is a back plan view, partly broken away, of the sleeve of FIG. 2;

FIG. 6 is a fragmentary sectional view taken substantially as indicated along the line 6—6 of FIG. 4;

FIG. 7 is a fragmentary sectional view taken substantially as indicated along the line 7—7 of FIG. 4;

FIG. 8 is a fragmentary sectional view taken substantially as indicated along the line 8—8 of FIG. 4;

FIG. 9 is a perspective view illustrating the sleeve during placement on a patient's leg;

FIG. 18 is an elevational view, partly broken away, of a sealing member for the connection device of FIG. 13;

DESCRIPTION OF THE PREFERRED EMBODIMENTS

Figure 4:
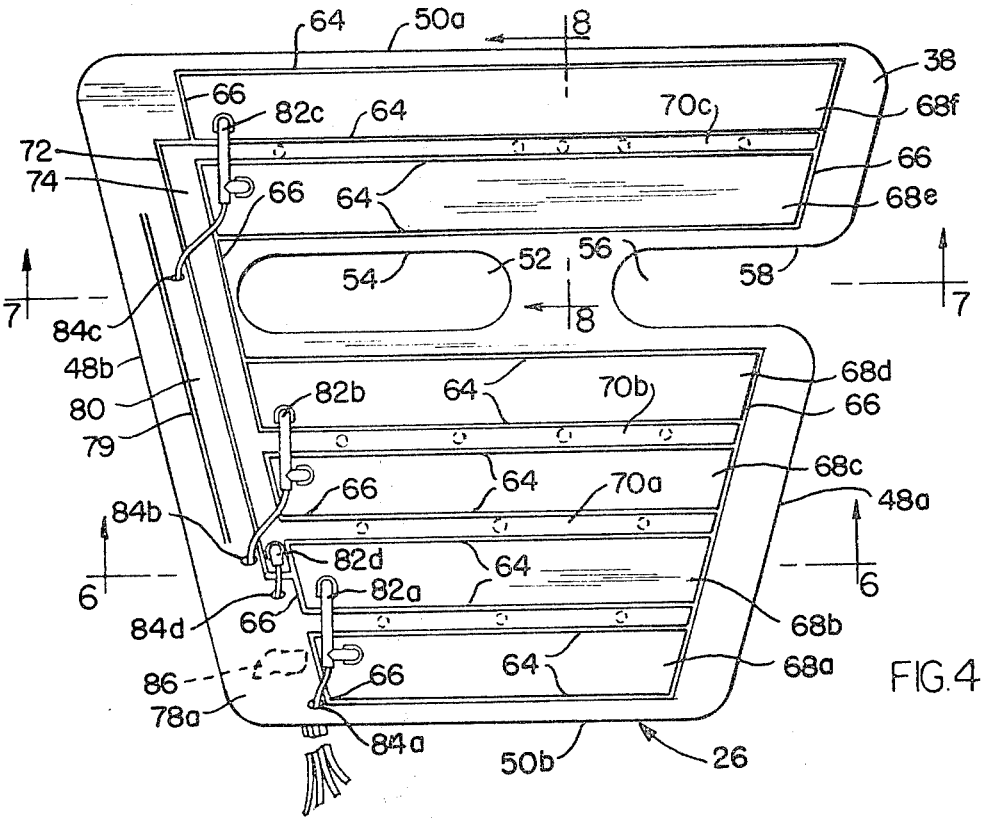
FIG. 4 is a front plan view of fluid impervious sheets defining chambers in the sleeve of FIG. 2.
Figure 5:
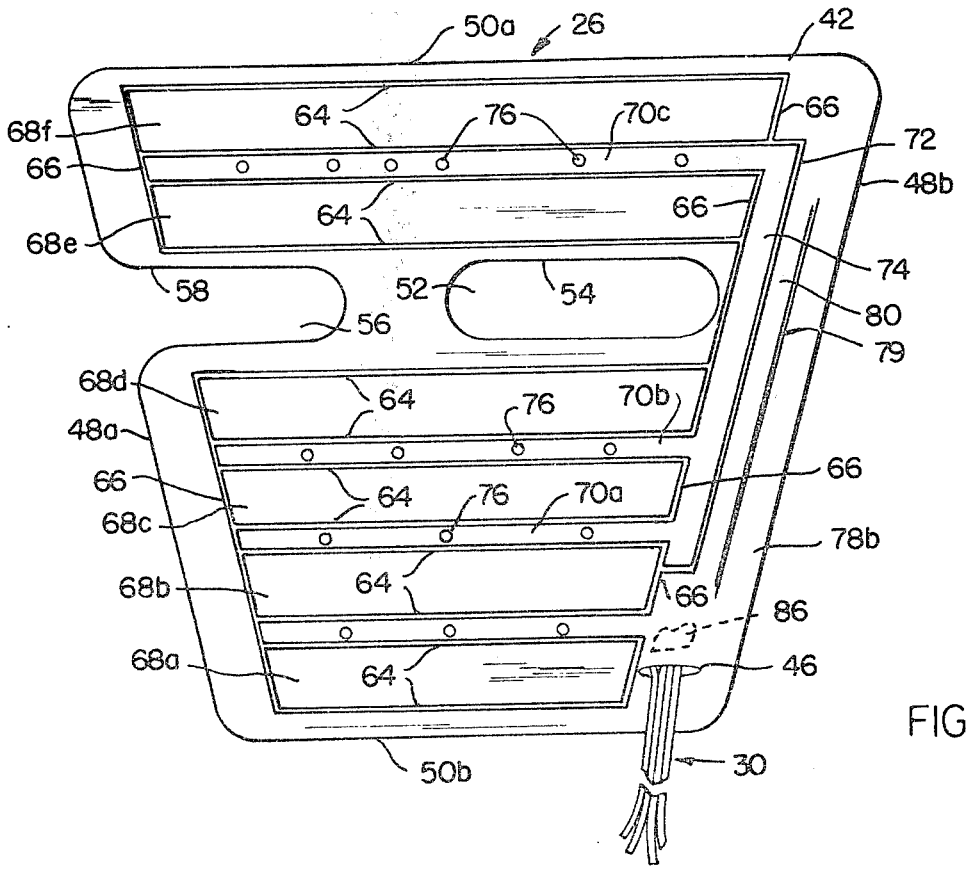
FIG. 5 is a back plan view of the fluid impervious sheets of FIG. 4.

Referring now to FIG. 1, there is shown an intermittent compression device generally designated 20 having a controller 22, and a pair of elongated compression sleeves 26 and 27 for enclosing a length of the patient's extremities, such as the legs as shown. The controller 22 supplies pressurized fluid through a conduit system 30 to the sleeves 26 and 27. The controller 22 may be of any suitable type, such as the controllers described in U.S. Pat. Nos. 4,013,069 and 4,030,488.

With reference to FIGS. 2 and 3, the sleeve 26 has an outer cover sheet 36 covering the entire outer surface of an outer fluid impervious barrier sheet 38. Also, the sleeve 26 has an inner cover sheet 40 covering an inner surface of an inner fluid impervious barrier sheet 42. The outer cover sheet 36 may comprise a relatively inelastic fabric with a brushed matte or napped finish of nylon or polyester, such as a fabric sold under the trademark Flannel/Flannel II, No. 11630, by Guilford Mills, Greensboro, N.C., which provides an attractive outer surface for the sleeve, and also defines brushed or napped fibers across the entire outer surface of the sleeve for a purpose which will be described below. In suitable form, the fabric of the sheet 36 may be warp knit from polyester yarns on a tricot machine after which the fabric is dyed to a suitable color, and the fabric is brushed or napped on a suitable machine to raise loops from the fabric. The inner cover sheet 40 may comprise a suitable nonwoven material which provides a comfortable inner surface of the sleeve for the patient. The barrier sheets may be formed from a suitable flexible plastic material, such as polyvinylchloride. If desired, a segment of the brushed nylon fabric may be formed into a tube 44 to cover the conduits which extend from the sleeve to the controller. As shown, the conduits and covering tube 44 may extend through an opening 46 in the inner cover sheet 40.

The sleeve 26 may have a pair of side edges 48*a* and 48*b*, and a pair of end edges 50*a* and 50*b* connecting the side edges 48*a* and *b*, with the side edges 48*a* and *b* being tapered toward a lower end of the sleeve. The sleeve 26 may also have an elongated opening 52 extending through a knee region 53 of the sleeve, and defined by peripheral edges 54 extending around the opening 52. In addition, the sleeve 26 has an elongated opening or cut-out 56 in the knee region 53 extending from the side edge 48*a* toward a lateral central portion of the sleeve, with the opening 56 being defined by peripheral edges 58 extending from the side edge 48*a* around the opening 56. As shown, the inner end of the opening 56 is spaced from the opening 54, and the opening 56 defines an upper flap 60 and a lower flap 62 of the sleeve which are separated by the opening 56. Further, the sleeve 26 may have a pair of lower fastening strips 61, such as a hook material sold under the trademark Velcro, secured to the inner cover sheet 40 along the side edge 48*b*.

With reference to FIGS. 4–8, the inner and outer fluid impervious barrier sheets 38 and 42 have a plurality of laterally extending lines 64, such as lines of sealing, connecting the barrier sheets 38 and 42 together, and longitudinally extending lines 66, such as lines of sealing, connecting the sheets 38 and 42 together and connecting ends of the lateral lines 64, as shown. The connecting lines 64 and 66 define a plurality of longitudinally disposed chambers 68*a*, 68*b*, 68*c*, 68*d*, 68*e*, and 68*f*, which for convenience will be termed contiguous. As shown, the chambers 48 extend laterally in the sheets 38 and 42, and are disposed in the longitudinal arrangement between the end edges 50*a* and 50*b*. When the sleeve is placed on the patient's leg, the lowermost chamber 68*a* is located on a lower part of the leg adjacent the patient's ankle, while the uppermost chamber 68*f* is located on an upper part of the leg adjacent the midthigh.

As shown, the longitudinal line 66 nearest the side edge 48*b* is separated intermediate the chambers 68*b* and *c*, 68*c* and *d*, and the chambers 68*e* and *f*. The lateral lines 64 define ventilation channels 70*a*, 70*b*, and 70*c* extending laterally in the sleeve from the longitudinal line 66 adjacent the side edge 48*a* toward the longitudinal lines 66 adjacent the side edge 48*b*, with the ventilation channels 70 being positioned at spaced locations longitudinally along the sleeve intermediate different pairs of adjoining chambers. Thus, the ventilation channel 70*a* is located intermediate the chambers 68*b* and 68*c*, the ventilation channel 70*b* is located intermediate the chambers 68*c* and 68*d*, and the ventilation channel 70*c* is located intermediate the chambers 68*e* and 68*f*. Moreover, the ventilation channels 70 have a width substantially less than the width of the chambers 68 such that the channels 70 do not detract from the size and volume required for the compression chambers 68. The inner and outer barrier sheets 38 and 42 also have a longitudinally extending line 72 which defines a connecting channel 74 intermediate the line 72 and the adjacent longitudinal line 66. As shown, the connecting channel 74 extends along the sides of the chambers 68*c*, 68*d*, and 68*e*, and communicates with the ventilation channels 70*a*, *b*, and *c*, such that the channel 74 connects the spaced ventilation channels 70. Further, the inner barrier sheet 42 has a plurality of openings or apertures 76 which communicate with the channels 70. Thus, when the sleeve 26 is placed on the patient's leg, the openings 76 face toward the leg.

With reference to FIGS. 4–7, the longitudinal lines 66 and 72 adjacent the side edge 48*b* define a pair of flaps 78*a* and 78*b* of the barrier sheets 38 and 42 which extend between the respective lines and the side edge 48*b*. As shown, the sheets 38 and 42 have a longitudinally extending line 79 which defines a directing channel 80 intermediate the lines 79 and 72, with the opposed longitudinal ends of the channel 80 being open. The sleeve 26 has a first connector 82*a* which is commonly connected in fluid communication to the two lowermost chambers 68*a* and 68*b*, and which is connected to a first conduit in the conduit system 30. As shown, the first conduit passes through an opening 84*a* in the upper barrier sheet flap 78*a* which retains the first conduit at the desired position in the sleeve 26. The sleeve 26 also has a second connector 82*b* which is commonly connected in fluid communication to the second pair of adjoining chambers 68*a* and 68*d*, and which is connected to a second conduit in the conduit system 30. The second conduit passes through an opening 84*b* in the upper flap 78*a* which retains the second conduit at the desired position. The sleeve 26 has a third connector 82*c* which is commonly connected in fluid communication to the uppermost chambers 68*e* and 68*f*, and which is connected to a third conduit in the conduit system 30. As shown, the third conduit passes through an opening 84*c* in the upper flap 78*a*, with the third conduit extending through the directing channel 80 in order to retain the third conduit at the desired position in the sleeve. The sleeve 26 also has a fourth connector 82*d* which is connected in fluid communication to the connecting channel 74 in order to permit passage of air to the ventilation channels 70. As shown, the connector 82*d* is connected to a fourth conduit in the conduit system, with the fourth conduit passing through an opening 84*d* in the upper barrier flap 78*a*. Thus, the first, second, and third conduits are separately connected to pairs of adjoining chambers, while the fourth conduit is connected to the connecting channel 74. Of course, the other sleeve 27 associated with the conduit system may be constructed in a similar manner. It will be apparent that the barrier flaps 78*a* and 78*b*, the directing channel 80, and the openings 84 cooperate to retain the conduits at the desired position within the sleeve. Further, the sleeve 26 has suitable securing means 86, such as regions of heat sealing or adhesive, bonding the flaps 78*a* and 78*b* to opposed sides of the conduits adjacent the opening 46. Thus, in the event that forces are applied to the conduits exterior the sleeve 26, the forces are transmitted to the flaps 78*a* and *b* rather than the connectors 82*a, b,* and *c,* in order to relieve possible strain from the connectors and prevent severance of the connectors from the sleeve.

In use, the sleeve 26 may be placed below the patient's leg preparatory to securement about the limb, as illustrated in FIG. 9. Next, the upper flap 60 and lower flap 62 may be independently passed around the patient's leg at locations above and below the knee, respectively. Thus, the opening 56 separates the flap portions of the sleeve in the region of the knee to permit independent wrapping of the upper and lower portions of the sleeve about the leg and simplify placement of the sleeve, as well as provide an improved fit. After both the upper and lower flaps 60 and 62 have been suitably wrapped about the patient's limb, the remaining part of the sleeve adjacent the side edge 48*b* may be wrapped over the flaps 60 and 62, and the fastening strips 61 may be pressed against the outer cover sheet 36. Thus, the hook fastening strips 61 engage with the brushed fibers of the outer cover sheet 36, such that the strips 61 and sheet 36 interengage and retain the sleeve in the wrapped configuration. Since the sheet 36 extends entirely across the outer surface of the sleeve 26, the sleeve may be readily adjusted as necessary for the desired fit according to the size of the patient's leg. Thus, the sleeve 26 may be placed in a simplified manner while accomplishing an improved fit on patients having varying leg sizes. In addition, the openings 52 and 56 greatly reduce the amount of material and bulk for the sleeve in the region of the patient's knee. Accordingly, the sleeve provides flexibility in the knee region in order to prevent binding and permit flexation of the knee during the extended periods of time while the sleeve is secured about the leg.

After placement of the sleeves on the patient's limbs, the controller 22 may be initiated in order to supply air to the sleeves 26 and 27 through the conduit system 30. The controller 22 intermittently inflates the chambers 68 during periodic compression cycles, and intermittently deflates the chambers 68 during periodic decompression cycles intermediate the compression cycles. The inelastic cover sheet 36 of the placed sleeve restricts the size of the inflated chambers, and greatly enhances the compressive action of the chambers to permit lower fluid volumes during the compression cycles. Further, the controller 22 supplies air through the conduits to the connecting channels 74 in the two sleeves. The air then passes from the common connecting channels 74 to the spaced ventilation channels 70 and through the openings 76 onto the patient's legs. In this manner, the device 20 ventilates a substantial portion of the patient's legs to prevent heat buildup and provide comfort for the patient during extended periods of time while the sleeves are retained in a wrapped condition about the patient's limbs. In a preferred form, the controller 22 supplies air to the ventilation channels 70 during the periodic decompression cycles.

With reference to FIG. 1, the conduit system 30 of the device 20 has a first set 90 of conduits 90*a, 90*b, 90*c,* and 90*d* communicating with the chambers of the sleeve 26 in a manner as previously described. The conduit system 30 also has a second set 92 of conduits 92*a, 92*b, 92*c,* and 92*d* in communication with chambers in the second sleeve 27 in a manner as previously discussed in connection with the sleeve 26. The conduit system 30 also has a third set 94 of conduits 94*a, 94*b, 94*c,* and 94*d* in communication with the controller 22.

Figure 10:
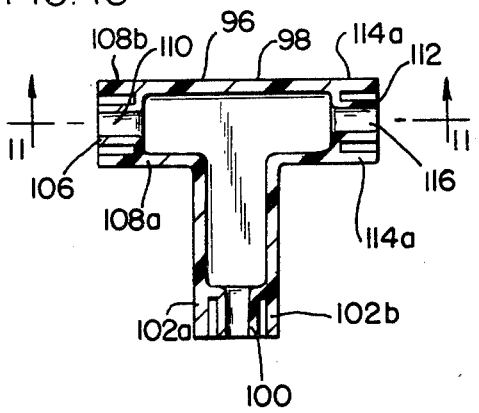
FIG. 10 is a sectional view of a connection member for conduit sets in a conduit system in the device of FIG. 1.
Figure 11:
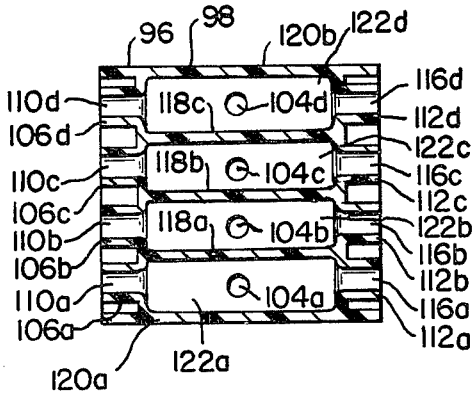
FIG. 11 is a sectional view taken substantially as indicated along the line 11—11 of FIG. 10.

The conduit system 30 has a connection member 96 which separately connects the conduits of the first and second sets 90 and 92, respectively, to the conduits 94 of the third set, and which may be made from a suitable material, such as plastic. With reference to FIGS. 10 and 11, the connection member 96 has a housing 98 having a plurality of tubular sections 100 spaced along the housing within a pair of opposed flanges 102*a* and 102*b*, with the tubular sections 100 defining associated ports 104*a, 104*b, 104*c,* and 104*d*. The tubular sections 100 are received in the conduits of the third conduit set 94, with the ports 104*a, b, c,* and *d* communicating respectively with the conduits 94*a, b, c,* and *d*, and with the ends of the conduits 94 being located intermediate the tubular sections 100 and the flanges 102*a* and *b*. The housing 98 also has a plurality of spaced tubular sections 106*a, 106*b, 106*c,* and 106*d* spaced beneath a pair of opposed flanges 108*a* and 108*b*, with the tubular sections 106*a, b, c,* and *d* defining respective ports 110*a, 110*b, 110*c,* and 110*d*. The conduits 90 in the first conduit set are attached to the tubular sections 106 with the conduits 90*a, b, c,* and *d* respectively communicating with the ports 110*a, b, c,* and *d*, and with the ends of the conduits 90 being located intermediate the tubular sections 106 and flanges 108*a* and *b*. The housing 98 also has a plurality of tubular sections 112*a, 112*b, 112*c,* and 112*d* spaced beneath opposed flanges 114*a* and 114*b*, with the tubular sections 112*a, b, c,* and *d* defining associated ports 116*a, 116*b, 116*c,* and 116*d*. The conduits 92 of the second conduit set are attached to the tubular sections 112 with the conduits 92*a, b, c,* and *d* respectively communicating with the ports 116*a, b, c,* and *d*, and with the ends of the conduits 92 being located intermediate the tubular sections 112 and flanges 114*a* and *b*.

The housing 98 also has a plurality of internal partitions 118*a, 118*b,* and 118*c* and a pair of opposed end walls 120*a* and 120*b* which define a plurality of separate cavities 122*a, 122*b, 122*c,* and 122*d*, such that the port 104*a* communicates with the ports 110*a* and 116*a* through the cavity 122*a*, the port 104*b* communicates with the ports 110*b* and 116*b* through the cavity 122*b*, the port 104*c* communicates with the ports 110*c* and 116*c* through the cavity 122*c*, and the port 104*d* communicates with the port 110*d* and 116*d* through the cavity 122*d*. Thus, in this manner the connection member 96 separates fluid flowing through the third conduit set 94 and separately distributes the fluid to the first conduit set 90 and the second conduit set 92, with the conduits 94*a, b, c,* and *d* communicating respectively with the conduits 90*a, b, c,* and *d* and 92*a, b, c,* and *d*. In a preferred form, the tubular sections 106 are generally aligned with the tubular sections 112, while the tubular sections 100 are orientated generally perpendicular to the aligned tubular sections 106 and 112.

Figure 12:
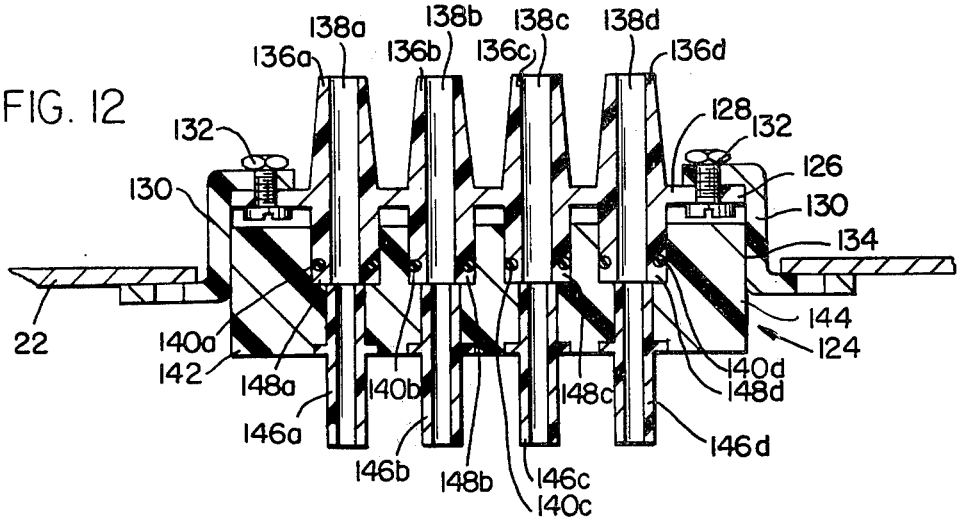
FIG. 12 is a sectional view of attachment members for connecting the conduit system to a controller in the device of FIG. 1.
Figure 13:
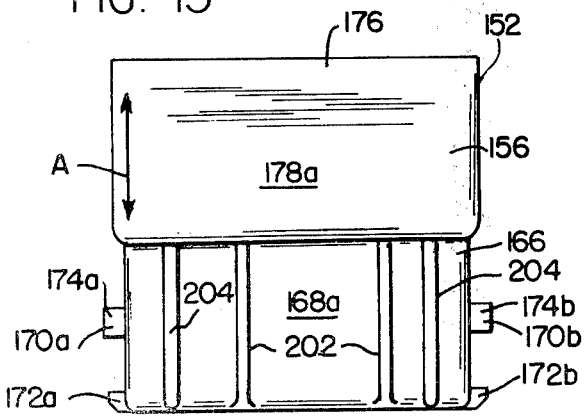
FIG. 13 is an elevational view of a connection device for releasably connecting conduit sections of the conduit sets together.
Figure 14:
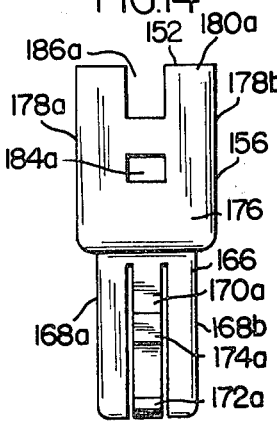
FIGS. 14 and 15 are elevational views taken from opposed sides of the connection device of FIG. 13.
Figure 15:
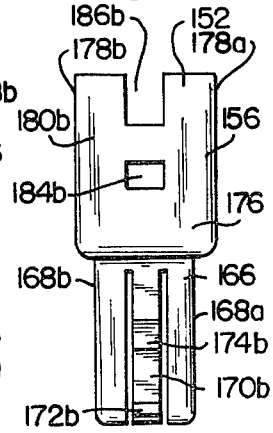

With reference to FIGS. 1 and 12, the controller 22 has a connection device 124 for releasably attaching the third conduit set 94 to the controller. The connection device 124 has a first connection member 126 of suitable material, such as plastic, having a plate 128 and a retaining flange 130 secured to the plate 128 by suitable means, such as screws 132, and with the connection member 126 defining a recess 134. The first connection member 126 has a plurality of tubular sections 136*a*, 136*b*, 136*c*, and 136*d* extending through the plate 128 and defining associated ports 138*a*, 138*b*, 138*c*, and 138*d*, with end portions of the tubular sections 136 extending on opposed sides of the plate 128. The outer end portions of the tubular sections 136*a*, *b*, *c*, and *d* have associated O-rings 140*a*, 140*b*, 140*c*, and 140*d*, constructed from a suitable material, such as rubber, for a purpose which will be described below. The connection device 124 also has a second connection member 142 of suitable material, such as plastic, having a housing 124 retaining a plurality of spaced tubular sections 146*a*, 146*b*, 146*c*, and 146*d*, with the tubular sections 146*a*, *b*, *c*, and *d* being received in upstream ends of the respective conduits 94*a*, *b*, *c*, and *d* of the third conduit set 94, such that the third conduit set 94 is attached to the second connection member 142. The housing 144 of the second connection member 142 also has a plurality of openings 148*a*, 148*b*, 148*c*, and 148*d* communicating with the respective tubular sections 146*a*, *b*, *c*, and *d*.

The second connection member 142 is releasably received in the recess 134 of the first connection member 126 with the outer ends of the tubular sections 136*a*, *b*, *c*, and *d* of the first connection member 126 being received in the associated openings 148*a*, *b*, *c*, and *d* of the second connection member 142, with the O-rings 140 providing sealing engagement between the tubular sections 136 of the first connection member 126 and the openings 148 of the second connection member 142. In this manner, communication is established between the ports 138*a*, *b*, *c*, and *d* of the first connection member 126 and the conduits 94*a*, *b*, *c*, and *d* of the third conduit set 94 when the second connection member 142 is attached to the first connection member 126. The controller 22 forms fluid pressure pulses which are separately connected inside the controller 22 to the ports 138*a*, *b*, *c*, and *d* during periodic inflation cycles, while the controller periodically exhausts fluid through the ports 138*a*, *b*, *c*, and *d* during periodic decompression cycles between the inflation cycles. In this manner, communication is established between the controller 22 through the ports 138 and the connection device 124 to the sleeves 26 and 27 through the third conduit set 94, the connection member 96, and the first and second conduit sets 90 and 92, respectively. Also, the second connection member 142 may be readily disconnected from the first connection member 126, in order to remove the controller 22 from the conduit system 30, as desired.

The first and second conduit sets 90 and 92, respectively, also have connection devices of identical design intermediate their lengths, and, for convenience, these connection devices will be discussed in connection with the first conduit set 90. Thus, with reference to FIG. 19, the first conduit set 90 has a connection device 150 comprising first and second connection members 152 and 154, respectively, which may be constructed of suitable material, such as plastic, which releasably connect downstream end portions of conduit sections 90*a*', 90*b*', 90*c*', and 90*d*', communicating with the controller 22, with upstream end portions of conduit sections 90*a*'', 90*b*'', 90*c*'', and 90*d*'', communicating with the chambers of the sleeve, with the conduit sections 90*a*', *b*', *c*', and *d*' and the sections 90*a*'', *b*'', *c*'', and *d*'' being, of course, sections of the respective conduits 90*a*, *b*, *c*, and *d* of the first conduit set 90.

As will be discussed below, the first and second connection members 152 and 154 are identical in construction, although used in different orientations, and will be described in connection with the first connection member 152. Thus, with reference to FIGS. 13–17, and 21, the connection member 152 has a housing 156 having a laterally extending plate 158. The connection member 152 has a plurality of laterally spaced tubular sections 160*a*, 160*b*, 160*c*, and 160*d* extending through the plate 158, with the tubular sections 160*a*, *b*, *c*, and *d* having associated first end portions 162*a*, 162*b*, 162*c*, and 162*d* being located on one side of the plate 158, and second end portions 164*a*, 164*b*, 164*c*, and 164*d* being located on the opposed side of the plate 158. The housing 156 has an elongated first cover section 166 of reduced dimensions having a pair of opposed spaced walls 168*a* and 168*b*, with the first cover section 166 extending peripherally around the first end portions 162*a*, *b*, *c*, and *d* of the tubular sections 160*a*, *b*, *c*, and *d*. The first cover section 166 has a pair of opposed locking members 170*a* and 170*b* comprising outwardly biased flanges having tapered protuberances 172*a* and 172*b* at the outer ends of the locking members 170*a* and *b*, and a pair of outwardly directed bosses 174*a* and 174*b* spaced inwardly from the protuberances 172*a* and *b* and being located intermediate ends of the locking members 170*a* and *b*.

The housing 156 also has an elongated second cover section 176 of enlarged dimensions having a pair of opposed spaced walls 178*a* and 178*b* and a pair of opposed sidewalls 180*a* and 180*b* connecting the walls 178*a* and *b*, with the walls 178*a* and *b* and the sidewalls 180*a* and *b* defining a cavity or recess 182 which is sufficiently large to receive the first cover section 166 within the second cover section 176. As shown, the opposed sidewalls 180*a* and *b* of the second cover section 176 have a pair of associated apertures 184*a* and 184*b* spaced from an outer edge of the second cover section 176, and a pair of associated notches 186*a* and 186*b* extending inwardly from the outer edge of the second cover section 176. As shown, the second cover section 176 extends peripherally around the second end portions 164*a*, *b*, *c*, and *d* of the tubular sections 160*a*, *b*, *c*, and *d*, respectively.

With reference to FIG. 18, the connection device 150 has a sealing member 188 of elastic and flexible material, such as polyvinylchloride, 70 durometer, having a laterally extending plate 190 and a plurality of spaced annular sections 192*a*, 192*b*, 192*c*, and 192*d* extending on opposed sides of the plate 190 and defining associated bores within the annular sections 192*a*, *b*, *c*, and *d*. As shown, one or both ends of the annular sections 192*a*, *b*, *c*, and *d* may have internal annular sealing rings 194.

Figure 19:
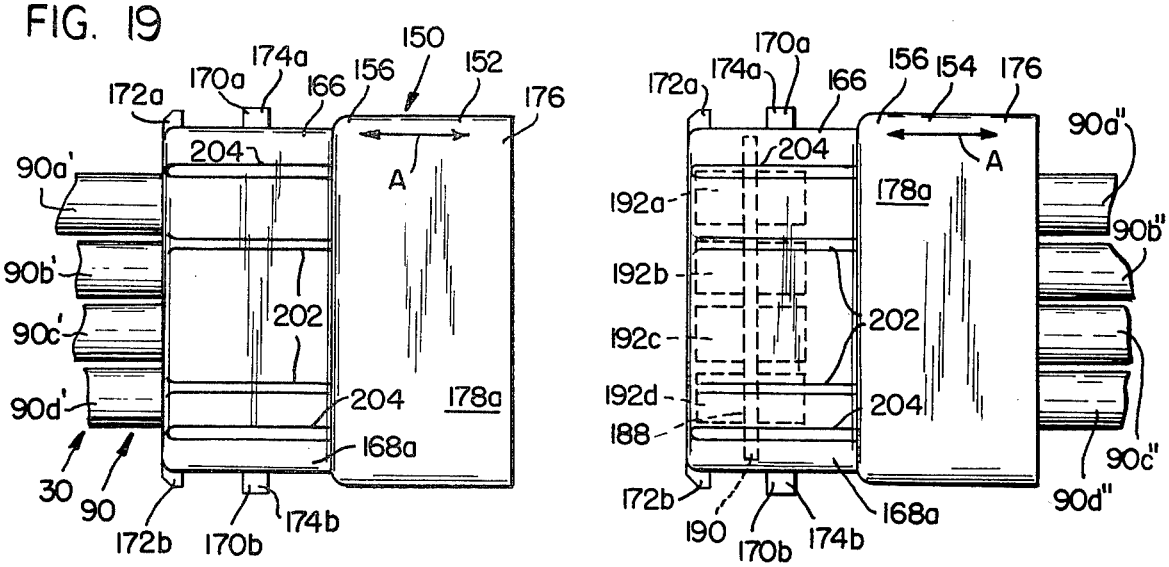
FIGS. 19 and 20 are fragmentary plan views illustrating use of a pair of the connection devices of FIG. 13 for releasably connecting conduit sections in the conduit sets together, with the connection devices being separated in FIG. 19, and with the connection devices being releasably attached in FIG. 20.
Figure 20:
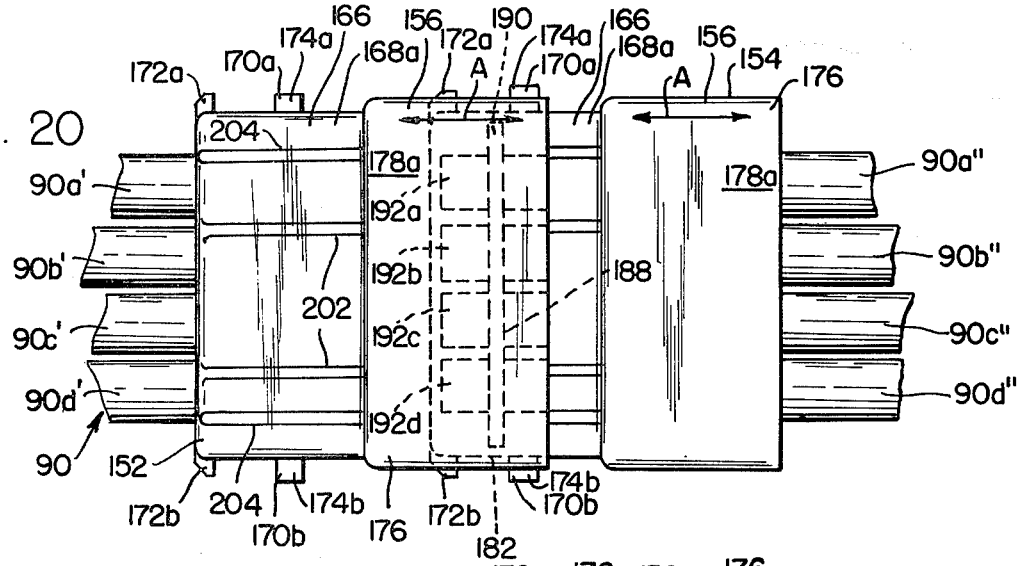
Figure 21:
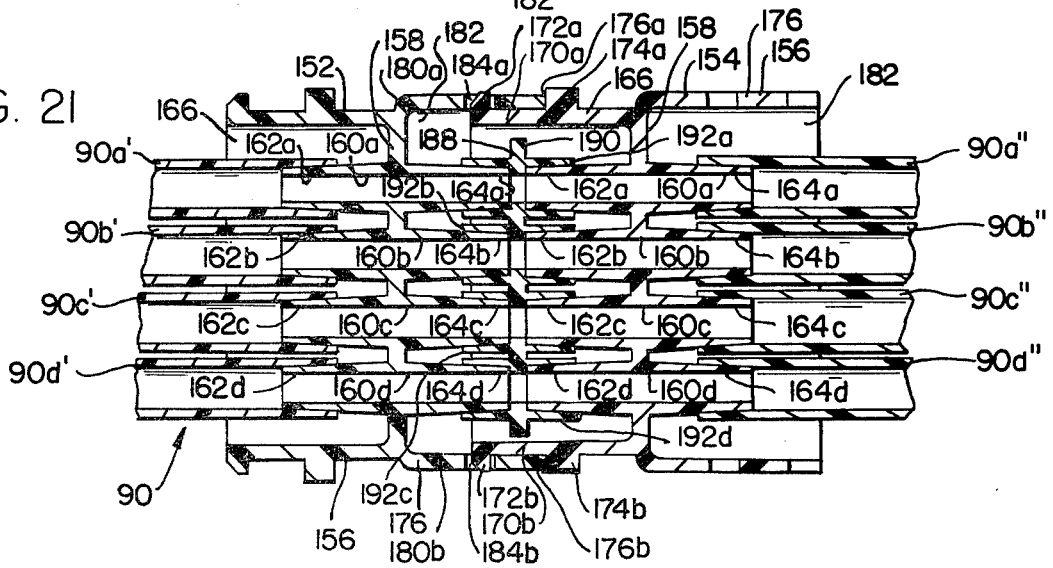
FIG. 21 is a fragmentary sectional view taken through the attached connection devices of FIG. 20.

The internal structure of the locked connection members 152 and 154 is illustrated in FIG. 21, and since the connection members 152 and 154 are identical in structure, although inverted, identical reference numerals will be utilized in the connection members 152 and 154 for convenience in discussion and under the belief that it will not create confusion. Thus, with reference to FIGS. 19–21, the first end portions 162*a*, *b*, *c*, and *d* of the associated tubular sections 160*a*, *b*, *c*, and *d* are received in the respective conduit sections 90*a*', *b*', *c*', and *d*' in order to secure the conduit sections to the first connection member 152. Conversely, the second end portions 164*a, b, c,* and *d* of the tubular sections 160*a, b, c,* and *d* of the connection member 154 are received in the conduit sections 90*a'', b'', c'',* and *d''* in order to secure these conduit sections to the connection member 154. The sealing member 188 may be secured on the connection member 154 with the first end portions 162*a, b, c,* and *d* of the tubular sections 160*a, b, c,* and *d* in the connection member 154 being received in the associated annular sections 192*a, b, c,* and *d* of the sealing member 188, and with the sealing rings 194 being located in the annular sections 192*a, b, c,* and *d* on the side of the plate 190 facing toward the connection member 152. The configuration of the connection members 152 and 154 and sealing member 188 with the connection members 152 and 154 and associated conduit sections detached is illustrated in FIG. 19.

With reference to FIGS. 20 and 21, when it is desired to connect the conduit sections together, the first cover section 166 of the connection member 154 is positioned in the cavity 182 defined by the second cover section 176 of the connection member 152, such that the second end portions 164*a, b, c,* and *d* of the tubular sections 160*a, b, c,* and *d* in the connection member 152 are received in the annular sections 192*a, b, c,* and *d* of the sealing member 188, with the sealing member 188 providing a seal between the tubular sections 160*a, b, c,* and *d* of both the connection members 152 and 154. In this manner, communication is established between the conduit sections 90*a', b', c',* and *d'* and the conduit sections 90*a'', b'', c'',* and *d''* through the respective tubular sections 160*a, b, c,* and *d* of the connection member 152, the sealing member 188, and the respective tubular sections 160*a, b, c,* and *d* of the connection member 154.

During placement of the first cover section 166 of the connection member 154 within the second cover section 176 of the connection member 152, the protuberances 172*a* and *b* of the associated locking members 170*a* and *b* of the connection member 154 are received in the respective apertures 184*a* and *b* of the connection member 152, with the locking members 170*a* and *b* being biased outwardly to lock the connection members 152 and 154 in place with the conduit sections in fluid communication. At the same time, the bosses 174*a* and *b* of the respective locking members 170*a* and *b* in the connection member 154 are received in the associated notches 186*a* and *b* of the connection member 152. Thus, when it is desired to disengage the connection members 152 and 154, the bosses 174*a* and *b* of the locking members 170*a* and *b* in the connection member 154 are depressed sufficiently to remove the associated protuberances 172*a* and *b* of the connection member 154 from the associated apertures 184*a* and *b* of the connection member 152, such that the connection member 154 may be withdrawn from the connection member 152.

Thus, the connection members 152 and 154 may be readily attached together in sealing engagement while the connection members 152 and 154 are automatically locked in the engaged configuration. Also, the connection members 152 and 154 may be readily detached from each other by pressing the locking members, as previously described. In this manner, the sleeves may be readily attached to the conduit system when desired, or a given sleeve may be removed from the conduit system, for example, in the case of an emergency, or after completion of use of the system. Also, it will be seen that the controller, conduit system, and sleeves may be supplied and stored separately, as desired. Moreover, the connection members 152 and 154 are of identical construction, thus simplifying the manufacturing procedures and reducing the cost of the connection members.

Figure 16:
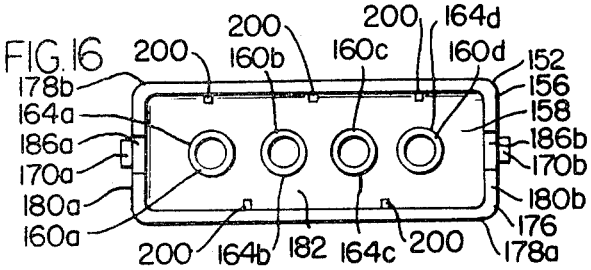
FIG. 16 is an upper plan view of the connection device of FIG. 13.
Figure 17:
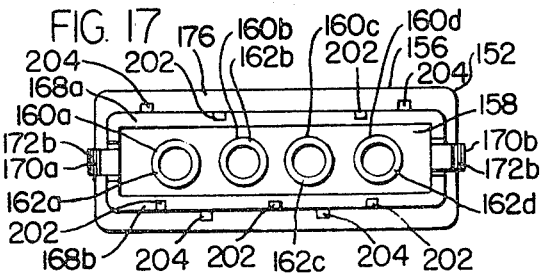
FIG. 17 is a lower plan view of the connection device of FIG. 13.

With reference to FIGS. 16 and 17, the first cover section 166 has a plurality of longitudinally extending internal flanges 200, and the second cover section 176 has a plurality of external longitudinal recesses 202 to receive the flanges 200 when the connection members 152 and 154 are locked together. The flanges 200 and recesses 202 facilitate alignment of the attached cover sections 166 and 176 of the connection members 152 and 154, and also assure correct orientation of the connection members 152 and 154 relative each other to assure correct connection of the tubular sections together. Also, with reference to FIGS. 19 and 20, the connection members 152 and 154 may have suitable indicia, such as arrows A, which serve to guide the user for proper orientation of the connection members 152 and 154 with the arrows aligned when the connection members 152 and 154 are attached together. With reference to FIGS. 16 and 17, the first cover section 166 also has a plurality of external longitudinally extending ribs 204 which serve to stabilize the first cover section 166 within the second cover section 176 and limit relative movement when the connection members 152 and 154 are attached together.

The foregoing detailed description is given for clearness of understanding only, and no unnecessary limitations should be understood therefrom, as modifications will be obvious to those skilled in the art.

We claim:

1. A device for applying compressive pressures against a patient's limb from a source of pressurized fluid, comprising:

a pair of first and second elongated pressure sleeves for enclosing a length of the patient's limbs, with said sleeves each having a plurality of fluid pressure chambers;

a first set of a plurality of conduits in communication with chambers in said first sleeve;

a second set of a plurality of conduits in communication with chambers in said second sleeve, with the number of conduits in said second set being the same as the number of conduits in said first set;

a third set of a plurality of conduits in communication with said source, with the number of conduits in said third set being the same as the number of conduits in said first and second sets; and means for connecting the conduits of said third set with the conduits of said first and second sets with each conduit in the third set being connected to only one conduit in each of said first and second sets to establish communication between the source and the first and second sleeves.

2. The device of claim 1 wherein said connecting means separately connects each of the conduits in said third set to separate conduits in said first and second conduit sets.

3. The device of claim 1 wherein the connecting means comprises a connection member having a first set of a plurality of attachment members for separate connection to the conduits of said first conduit set, a second set of a plurality of attachment members for separate connection to the conduits of said second conduit set, and a third set of attachment members for separate connection to the conduits of said third conduit set, said connection member separately communicating between the attachment members of said third set and associated attachment members in said first and second sets.

4. The device of claim 3 wherein the attachment members of said first, second, and third sets comprise tubular sections received in end portions of the associated conduits in said first, second, and third conduit sets.

5. The device of claim 3 wherein the attachment members of said first set are generally aligned with the attachment members of said second set.

6. The device of claim 5 wherein the attachment members of said third set are oriented generally perpendicular relative to the alignment of said first and second attachment member sets.

7. The device of claim 1 wherein the lengths of the conduits in said first conduit set are approximately equal to the lengths of the corresponding conduits in said second conduit set.

8. The device of claim 1 including means for intermittently inflating and deflating the chambers of said sleeves.

9. A device for applying compressive pressures against a patient's limb from a source of pressurized fluid, comprising:

a pair of first and second elongated pressure sleeves for enclosing a length of the patient's limbs, with said sleeves each having a plurality of fluid pressure chambers;

conduit means comprising a plurality of conduits communicating between said source and the chambers of said first and second sleeves, with a first set of a plurality of conduits communicating with the first sleeve and a second set of a plurality of conduits communicating with the second sleeve; and means for selectively connecting and disconnecting said conduit means separately from either of said first and second sleeves at a location intermediate the length of said conduit means, said connecting and disconnecting means comprising a first pair of connection members attached to a plurality of conduits in said first set, a second pair of connection members attached to a plurality of conduits in said second set, and means for releasably attaching said first and second pairs of connection members together.

10. A device for applying compressive pressures against a patient's limb, comprising:

an elongated pressure sleeve for enclosing a length of the patient's limb, with the sleeve having a plurality of fluid pressure chambers;

a controller for developing pressurized fluid through a plurality of ports;

a plurality of conduits communicating with the sleeve chambers; and means for releasably connecting the conduits in communication with said ports, said connecting means comprising a first connection member attached to the controller and communicating separately with said ports, and a second connection member in separate communication with said conduits, with said first and second connection members being releasably attachable together with the conduits separately communicating with said ports.

11. The device of claim 10 wherein said second connection member includes a plurality of tubular sections separately received in ends of said conduits.

12. The device of claim 10 wherein at least one of said connection members includes a plurality of tubular sections, and the other of said connection members includes a plurality of openings to receive said tubular sections, such that the conduits communicate with the ports through the attached first and second connection members.

13. The device of claim 12 including sealing means located intermediate the tubular sections and openings when the first and second connection members are attached together.

14. The device of claim 12 wherein at least one of said connection members includes a recess to receive the other of said connection members when the first and second connection members are attached together.

15. A device for applying compressive pressures against a patient's limb from a source of pressurized fluid, comprising:

an elongated pressure sleeve for enclosing a length of the patient's limb, with said sleeve having a plurality of fluid pressure chambers;

a first set of a plurality of conduits in communication with chambers in said sleeve, and having upstream ends relative to said sleeve;

a second set of a plurality of conduits in communication with said source, and having downstream ends relative to said source; and means for releasably connecting the upstream ends of the first conduit set in separate fluid communication with the downstream ends of said second conduit set, said connecting means comprising a first connection member attached to the upstream ends of the plural conduits in the first set, a second connection member attached to the downstream ends of the plural conduits in the second set, and means for releasably attaching said first and second connection members together.

16. A device for applying compressive pressures against a patient's limb from a source of pressurized fluid, comprising:

an elongated pressure sleeve for enclosing a length of the patient's limb, with the sleeve having a plurality of fluid pressure chambers;

a first set of a plurality of conduits communicating with said chambers;

a second set of a plurality of conduits communicating with said source;

a first connection member comprising a first housing having a plurality of first ports, and means for separately connecting the housing to separate conduits of said first conduit set with the conduits separately communicating with said ports of the first connection member;

a second connection member comprising a second housing having a plurality of second ports, and means for separately connecting the housing to separate conduits of said second conduit set with the conduits separately communicating with said ports of the second connection member; and means for releasably attaching the first connection member to the second connection member with the ports of the first connection member separately communicating with the ports of the second connection member to establish separate communication between the conduits of said first and second sets.

17. The device of claim 16 wherein the first and second connection members are identical in structure.

18. The device of claim 16 wherein said first connection member has a plurality of first tubular sections defining said ports of the first connection member, said second connection member having a plurality of second tubular sections defining said ports of the second connection member, with said first and second ports being generally aligned when the first and second connection members are attached together.

19. The device of claim 18 including a sealing member of elastic material having a plurality of annular sections having opposed ends to receive the first and second tubular sections in sealing engagement.

20. The device of claim 19 wherein said sealing member has a laterally extending plate located intermediate the ends of the annular sections and connecting said annular sections together.

21. The device of claim 19 in which at least a portion of said annular sections have internal sealing rings to snugly engage the associated tubular sections received in the annular sections.

22. The device of claim 18 wherein said first connection member has a first cover member extending peripherally around the first tubular sections and defining a recess, and in which said second connection member has a second cover member extending peripherally around the second tubular sections with said second cover member being smaller in dimensions than the first cover member such that the second cover member is received in the recess of the first cover member when the first and second connection members are attached together.

23. The device of claim 22 wherein said first cover member has a pair of opposed side openings, and in which the second cover member has a pair of outwardly biased locking members at opposed sides of the second cover member, said locking members having outwardly directed protuberances being releasably received in the openings of the first cover member to releasably attach the first and second connection members together.

24. The device of claim 23 wherein said first cover member has a pair of opposed notches at an outer edge of the first cover member, and in which said locking members have a pair of outwardly directed bosses spaced from said protuberances, said bosses being received in the notches of the first cover member when the first and second connection members are locked together.

25. The device of claim 16 wherein said first housing has a laterally extending plate, a plurality of spaced first tubular sections extending through said plate with first end portions of the first tubular sections being located on one side of the plate and being received in conduit ends of said first conduit set, and with second end portions of the first tubular sections being located on the other side of said plate and defining said first ports, said first housing having a first cover section of reduced dimensions extending peripherally around the attached conduits of said first set, and a second cover section of enlarged dimensions extending peripherally around the second end portions of the first tubular sections, in which said second housing has a laterally extending plate, a plurality of spaced second tubular sections extending through said plate with first end portions of the second tubular sections being located on one side of the plate and defining said ports, and with second end portions of the second tubular sections being located on the other side of said plate and being received in conduit ends of said second conduit set, said second housing having a first cover section of reduced dimensions extending peripherally around the first end portions of the second tubular sections, and a second cover section of enlarged dimensions extending peripherally around the attached conduits, said first cover section of the second connection member being received in the second cover section of the first connection member when the first and second connection members are attached together.

26. The device of claim 25 wherein said second cover section of the first housing has a pair of opposed side openings, and in which the first cover section of the second housing has a pair of opposed outwardly biased locking members, said locking members having outwardly directed protuberances being releasably received in said openings to releasably attach the first and second connection members together.

27. The device of claim 26 wherein said second cover section of the first housing has a pair of opposed notches at an outer edge of the said second cover section, and in which said locking members have a pair of outwardly directed bosses spaced from said protuberances, said bosses being received in the notches of the said second cover section when the first and second connection members are locked together.

28. The device of claim 26 including a sealing member of elastic material having a plurality of annular sections having opposed ends to receive the second end portions of the first tubular sections and the first end portions of the second tubular sections when the first and second connection members are attached together.

29. A device for applying compressive pressures against a patient's limb from a source of pressurized fluid, comprising, an elongated pressure sleeve for enclosing a length of the patient's limb, with the sleeve having a plurality of fluid pressure chambers;

a plurality of conduits for passage of fluid;

a housing having a lateral plate, a plurality of laterally spaced tubular sections extending through said plate with first end portions of said tubular sections being located on one side of said plate, and with second end portions of the tubular sections being located on the other side of said plate, a first elongated cover section of reduced dimensions extending peripherally around said first end portions of said tubular sections, and having a pair of outwardly biased locking members at opposed sides of the first cover section, said locking members having outwardly directed protuberances, said housing having an elongated second cover section of enlarged dimensions extending peripherally around the second end portions of said tubular sections, and a pair of apertures at opposed sides of the second cover section, said first cover section having dimensions such that said first cover section could be received in the second cover section with the first tubular end portions of said first cover section generally aligned with the second tubular end portions of the second cover section, and such that said locking member protuberances could be releasably received in said apertures such that said first and second cover sections could be releasably locked together with said locking members.

30. The connection member of claim 29 wherein said second cover section includes a pair of notches at opposed sides and an outer edge of the second cover section, and in which said locking members include a pair of outwardly directed bosses spaced from said protuberances, such that said bosses could be received in said notches if the first and second cover sections would be locked together.

31. A device for applying compressive pressures against a patient's limb from a source of pressurized fluid, comprising:

a pair of first and second elongated pressure sleeves for enclosing a length of the patient's limb, with said sleeves each having a plurality of fluid pressure chambers;

a first set of a plurality of conduits in communication with chambers in said first sleeve and having pairs of separate conduit sections;

a second set of a plurality of conduits in communication with chambers in said second sleeve and having pairs of separate conduit sections;

a third set of a plurality of conduits in communication with said source;

means for connecting the conduits of said third set with the conduits of said first and second sets to establish communication between the source and the first and second sleeves; and means for releasably attaching the conduit sections of the first and second conduit sets together with the separate conduit sections in each set communicating with each other when attached.

* * * * *